United States Patent [19]

Crowell

[11] Patent Number: 4,774,780

[45] Date of Patent: Oct. 4, 1988

[54] BENT RESILIENT LEAF SPRING POP-UP DISPLAY ASSEMBLIES

[75] Inventor: Christopher S. Crowell, Old Lyme, Conn.

[73] Assignee: Structural Graphics Inc., Essex, Conn.

[21] Appl. No.: 908,184

[22] Filed: Sep. 17, 1986

[51] Int. Cl.[4] ..... G09F 1/00

[52] U.S. Cl. ..... 40/124.1; 446/147; 446/148; 446/149; 446/150

[58] Field of Search ..... 40/124.1; 446/227, 148, 446/149, 150, 486, 487, 488

[56] References Cited

U.S. PATENT DOCUMENTS

| | | | |
|---|---|---|---|
| 1,162,230 | 11/1915 | Foster | 40/486 |
| 2,428,519 | 10/1947 | Gustafson | 248/454 |
| 3,044,758 | 7/1962 | Lawson | 267/143 |
| 3,208,173 | 9/1965 | Shank | 40/592 |
| 3,427,642 | 2/1969 | Mohr | 40/124.1 |
| 4,145,731 | 3/1979 | Adamich | 362/123 |

*Primary Examiner*—John J. Wilson
*Assistant Examiner*—Michael Lynch
*Attorney, Agent, or Firm*—Mattern, Ware, Stoltz & Fressola

[57] ABSTRACT

A self-erecting pop-up stationery display structure assembly bonded to an underlying stationery sheet supports a display panel positioned overlying the stationery sheet. The collapsible self-erecting support has a central panel spanning the space between the stationery sheet and the overlying display panel, with first and second end panels joined to it by respective first and second fold lines, the first being formed of resilient elastomer leaf spring sheet material with a preformed angular bend formed therein. A collapsing force causes the central panel to fold toward the stationery sheet, elastically deforming the preformed angular bend in the resilient elastomer sheet. Removal of the collapsing force releases the deformed ångular bend, which returns elastically to its preformed bend configuration, positioning the display panel in a deployed position spaced from the stationery panel.

9 Claims, 1 Drawing Sheet

BENT RESILIENT LEAF SPRING POP-UP DISPLAY ASSEMBLIES

This invention relates to collapsible pop-up display assemblies, and particularly to stationery and mailing advertising pieces customarily folded with two adjacent panels compressing between themselves collapsible pop-up displays.

The pop-up structures of this invention are characterized by a bent resilient plastic spring formed of thin sheet plastic material formed with an angular bend, preferably an acute angle bend which is resiliently depressed in the collapsed mode of the structure between two panels of a folded stationery sheet or greeting card, or between the two faces of an envelope, for example, to be released when the envelope is opened or the foldable card is unfolded to pop up resiliently to its deployed condition displaying a supported structure above the surface of the backing sheet of stationery.

BACKGROUND ART

Many different unfolding pop-up structures have been proposed and used for decades in greeting cards, books and advertising novelties. These pop-up displays have employed multi-sheet pictorial structures of different degrees of complexity, and they are normally erected by an articulating panel connected by a fold line to one of the hinged pop-up panels and serving to draw the structure from its collapsed condition to its erect, pop-up condition either automatically, as in my U.S. Pat. No. 4,592,573, or by manual actuation, as in my U.S. Pat. No. 4,441,270.

Compressed steel springs have been employed for generations to produce a pop-up deployment of a display structure, as in the conventional Jack-in-the-Box, when the compression force is released by the user. Resilient wire springs and wire coil springs have been proposed for use in pop-up greeting cards where the compressed spring is released as the card is unfolded.

The use of a bent plastic leaf spring having a predetermined angular bend determining its relaxed deployed shape, which may be resiliently bent by a compressive force applied to the plastic leaf spring as it is depressed between two panels of a folded stationery sheet or between the two faces of an envelope, is believed to be unique in the pop-up advertising display and greeting card stationery field. Sheet plastic material used in most stationery and display products is normally manufactured for use only in a single display mode, and is not normally provided with a two-mode configuration capable of resilient collapsed mode storage and released pop-up mode deployment.

Accordingly, a principal object of the present invention is to provide folded greeting cards, novelty stationery and advertising pop-up novelties incorporating a deployable panel resiliently supported above the face of an underlying panel by a collapsible and erectable pop-up support structure, automatically deployed to its pop-up condition when collapsing force is removed.

Another object of the present invention is to provide such collapsible, pop-up display structures incorporating a bent resilient leaf spring formed of plastic material with a permanent angular bend formed therein, providing resilient collapsibility as the angular bend is resiliently depressed to minimize the acute bend angle, and automatically deployed to its pop-up condition as the depressing force is removed.

A further object of the invention is to provide folded stationery, greeting cards and advertising novelties incorporating a bent resilient plastic leaf spring, forming one corner fold line of a collapsible quadrilateral support structure positioned between the underlying panel and the overlying deployable display panel.

Still another object of the invention is to provide a bent resilient plastic leaf spring having a Z-shaped cross-section configuration incorporating two opposite preformed acute angle bends, wherein the upper and lower arms of the Z-shaped cross section are adhesively adhered to the underlying panel and the overlying display panel respectively, providing a bouncing, bobbing deployed display of the overlying display panel.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

FIGS. 9, 10, 11 and 12 are successive views of the support structure of FIGS. 1–4, showing the succeeding steps in its fabrication, FIG. 9 being a top plan view of two blanks incorporated in each quadrilateral support structure of the kind shown in FIG. 4, while FIGS. 10, 11 and 12 are successive cross-sectional side elevation views of the same structure at different stages of its fabrication.

THE BEST MODE FOR CARRYING OUT THE INVENTION

Figure 1:
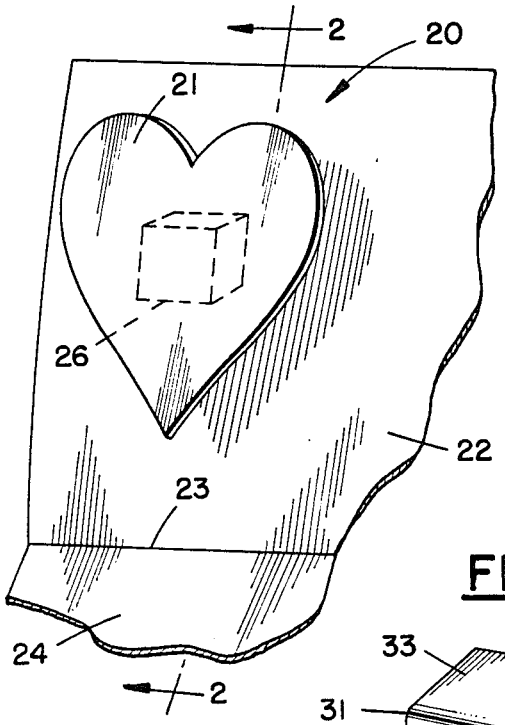
FIG. 1 is a fragmentary front perspective view of a preferred embodiment of the invention showing the upper left-hand corner of a folded stationery sheet with its hinged panels unfolded with a pop-up display panel deployed, upstanding above the face of the uppermost stationery panel.

The pop-up display structure 20 shown in FIG. 1 comprises a display panel 21 deployed at a predetermined distance above the underlying stationery panel 22, which is connected by a fold line 23 to a contiguous stationery panel 24. Display panel 21 is joined to underlying panel 22 by a collapsible support 26, concealed behind display panel 21 in FIG. 1 and shown there in dashed lines. Support 26 is shown in FIG. 4 and in the two cross-sectional end elevation views of FIGS. 2 and 3, where it will be observed to be a collapsible quadrilateral structure, which is collapsed by flattening two of its diametrically opposed folds and thereby folding the opposite diametrically opposed folds to smaller acute angles until the diamond-shaped structure is substantially flattened.

Figure 9:
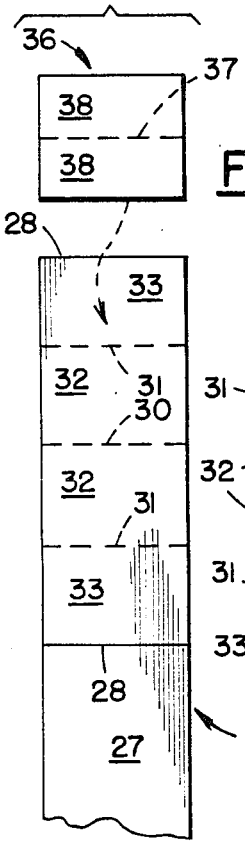
Figure 10:
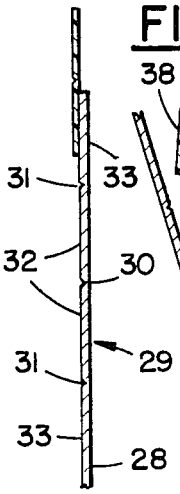

As indicated in FIGS. 9 and 10, support structure 26 is formed by severing from a sheet or a supply strip 27 along a transverse severing line 28 a suitable length of the supply strip, producing a blank 29, which may be formed of paper, thin panel board, poster board or other bendable, foldable stationery material. The severed rectangular blank 29 is crossed by three transverse score lines, a central score line 30 and two intermediate score lines 31. Blank 29 is thus scored into four successive substantially similar rectangular panels, two central panels 32 flanking the central foldable score line 30, and two end panels 33 joined to central panels 32 by the intermediate foldable score lines 31.

Thus, as shown in FIG. 9, the series of four panels 33-32-32-33 are arrayed contiguously side by side. The resilient spring pop-up action of the support structure 26 is provided by a thin plastic sheet leaf spring 36, shown at the upper end of FIG. 9 in its flattened blank condition before it is formed into its pop-up deployed position by thermoforming an angular bend 37 transversely across its major dimension. Thus the leaf spring 36 has two similar rectangular panels 38, integrally joined together along the fold line 37. The thermoformed fold line 37 preferably sets the two panels 38 at an included angle of between 80 and 100 degrees, more or less equal to a right angle bend in leaf spring 36, as indicated at the upper end of FIG. 10 where spring 36 has one of its panels 38 overlying the adjacent end panel 33 of blank 29, and bonded to this panel 33 by any suitable adhesive.

Figure 11:
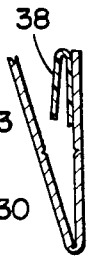

As shown in FIG. 11, blank 29 is then folded about its central score line 30 to bring its opposite end panel 33 into juxtaposition with the free and angularly extending panel 38 of leaf spring 36. This free panel 38 is then depressed between the two end panels 33 of blank 29, where its outer surface is similarly adhesively bonded to the facing surface of panel 33 to form the diamond-shaped or parallelogram structure shown in FIG. 12 and also shown in perspective in FIG. 4.

Figure 2:
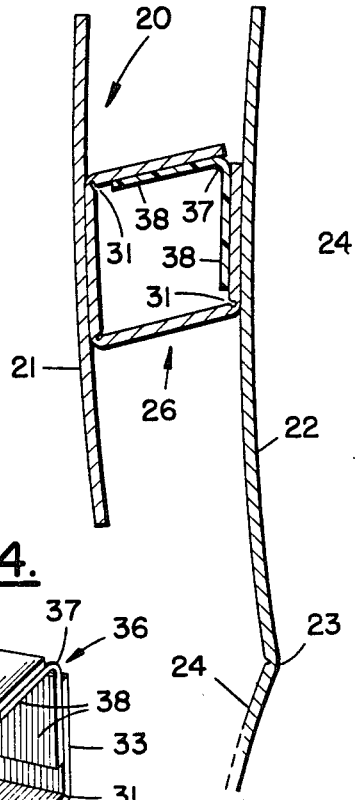
FIG. 2 is a fragmentary enlarged cross-sectional side elevation view of the upper portion of the stationery sheet shown in FIG. 1, taken along the plane 2—2 in FIG. 1, with the upstanding pop-up display panel deployed above the face of the underlying stationery sheet showing the support structure in cross-sectional side elevation.

When leaf spring 36 has thus been adhesively bonded between the facing surfaces of end panels 33 of blank 29, its thermoformed hinge line 37 becomes the fourth fold line, parallel to score lines 30 and 31, securing the blank 29 into the shape of a quadrilateral structure having a diamond-shaped cross-section, as indicated in FIGS. 2 and 4. When oppositely acting forces are applied to the two score lines 31, tending to urge them toward each other, the quadrilateral structure 26 will be collapsed from its deployed mode position shown in FIG. 2 to its collapsed mode position shown in FIG. 3 and FIG. 12. In this collapsed position, the flexible resilient leaf spring 36 is deformed by being bent along its thermoformed hinge line 37, bringing its panels 38 angularly closer together, and making the fold along hinge line 37 a more acute angle when viewed end-wise, as shown in FIGS. 3 and 12.

Figure 3:
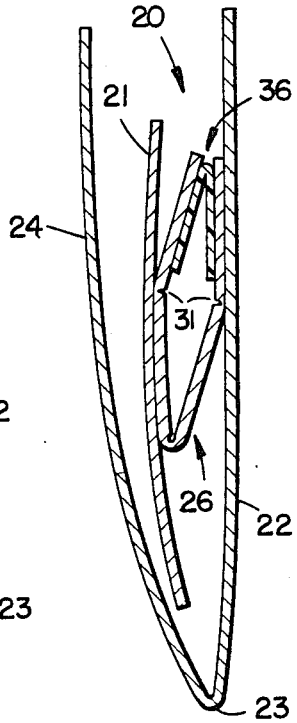
FIG. 3 is a corresponding cross-sectional side elevation view of the stationery sheet and pop-up display structure shown in FIGS. 1 and 2, with the pop-up panel being depressed to its collapsed position by folding of the stationery panels toward each other about their common fold line.
Figure 4:
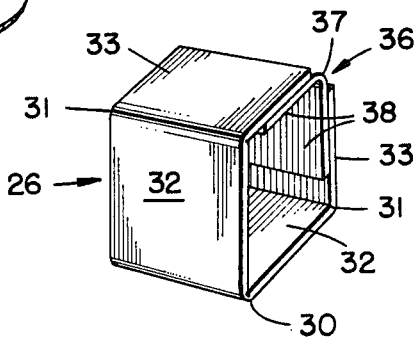
FIG. 4 is an enlarged perspective view of the quadrilateral support structure incorporated in the pop-up display device illustrated in FIGS. 1–3, with its bent resilient plastic leaf spring being shown in its deployed position.

By comparing the deployed and collapsed modes illustrated in FIGS. 2 and 3, the resilient depressible collapsibility of support structure 26 is readily observed. In its deployed mode, structure 26 forms a "fat" diamond closely resembling a square when viewed end-wise, thus positioning display panel 21 a substantial distance forward of the upper stationery panel 22, and presenting to the observer a pronounced three-dimensional effect, as indicated in FIG. 1. This is the normal display mode position of the assembly, which it retains at all times when it is normally exposed to view.

Figure 12:
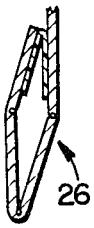

It is only when a collapsing force is applied to display panel 21, tending to bring to the two fold lines 31 closer together and to flatten the "fat" diamond structure 26 into a much "thinner' diamond, shown in FIGS. 3 and 12, that the structure 26 flattens toward its collapsed mode. The collapsed mode is retained over any period required merely by continuing the collapsing force application, and thus maintaining the support structure 26 in its collapsed mode. Stationery panels 22 and 24, folded together about their common fold line 23, easily maintain the collapsed mode of FIG. 3, particularly when slipped into a covering envelope. In this mode, the two panels 38 of resilient plastic leaf spring 36 are bent toward each other, placing elastic stress on the thermoformed fold line 37, but the resilient elastomer material of plastic leaf spring 36 is not thereby bent or broken or permanently deformed, since this normal collapsing force does not stress the fold line 37 beyond its yield point. The fold line 37 remains elastic, and removal of the collapsing force results in the pop-up deployment of display panel 21 as leaf spring 36 resumes its normal thermoformed position illustrated in FIGS. 2 and 4. Since leaf spring 36 is formed of resilient flexible elastomer material, the successive collapse and pop-up deployment of support structure 26 may be repeated a great number of times without adversely affecting the resiliency of leaf spring 36.

A different form of the collapsible and pop-up deployable support structures of the present invention is illustrated in FIGS. 5, 6, 7 and 8. In these Figures, the invention is characterized by a leaf spring having a different cross-sectional configuration, a Z-shape, with an elongated central panel joined to reversely bent end panels having their integral hinge lines thermoformed in acute angles extending on opposite sides of the central panel.

Figure 8:
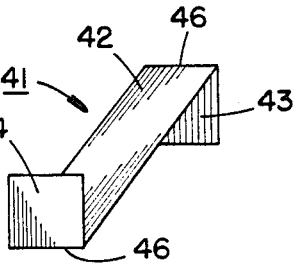
FIG. 8 is a corresponding perspective view of the same Z-shaped leaf spring in its released deployed mode position.

Thus, as shown in FIG. 8, the leaf spring 41 has an elongated central panel 42, a base panel 43 and an outer panel 44. Base panel 43 and outer panel 44 are each integrally defined by thermoformed hinge lines 46, setting the end panels 43 and 44 on opposite sides of central panel 42, positioned at opposite acute angles, making the two panels 43 and 44 virtually parallel to each other. Thermoformed hinge lines 46 are set to create acute angles in the neighborhood of 30 degrees between central panel 42 and the two end panels 43 and 44.

Figure 7:
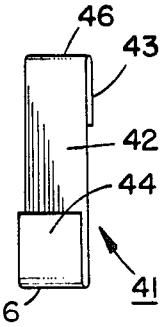
FIG. 7 is a perspective view of the Z-shaped bent resilient plastic leaf spring support structure shown in FIGS. 5 and 6, in its collpased mode position.
Figure 5:
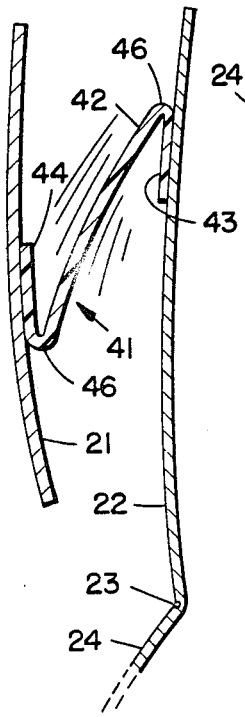
FIG. 5 is a fragmentary cross-sectional side elevation view of a different embodiment of the invention showing a pop-up display panel deployed above the face of the underlying stationery panel mounted upon a resilient plastic leaf spring formed with two opposite acute angle bends in a Z-shaped configuration.
Figure 6:
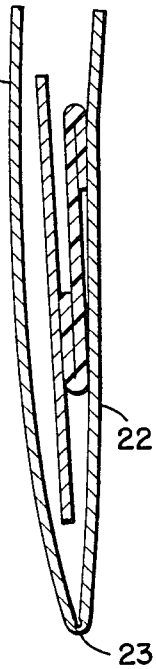
FIG. 6 is a corresponding fragmentary cross-sectional side elevation view showing the same Z-shaped bent resilient plastic leaf spring support structure and display panel of FIG. 5, resiliently depressed to its collapsed position by the folding together of two contiguous stationery panels about their common fold line.

The relaxed deployed mode position of the leaf spring 41 is shown in FIG. 8 and in the assembled stationery piece illustrated in FIG. 5, where the display panel 21 is shown deployed a substantial distance in front of the upper stationery panel 22. The collapsed mode of this Z-shaped leaf spring 41 is illustrated in FIGS. 6 and 7. As shown in FIG. 6, when a collapsing force is applied to reduce these corresponding angles between the end panels 43 and 44 and the central panel 42, the Z-shaped resilient leaf spring is flattened into an S-shape, compressed between the collapsed display panel 21 and the underlying stationery panel 22. This collapsing force tending to maintain the Z-shaped resilient leaf spring 41 in its collapsed mode, shown in FIGS. 6 and 7, is normally maintained by the folded configuration of the two contiguous stationery sheets 22 and 24 folded together about their common hinge line 23 as shown in FIG. 6.

The Z-shaped resilient leaf spring 41 is equally as strong, sturdy and reliable as the collapsible support structure 26 shown in FIGS. 2 and 4 with the bent leaf spring 36 having a single thermoformed hinge line 37. However, one significant difference between these two different shapes of resilient, elastomer leaf springs is the vibrational stability they exhibit. The Z-shaped spring, being a cantilevered structure, tends to bounce and vibrate with notable instability, providing a bobbing action to the display panel 21 mounted thereon, and forming an eye-catching display for the casual observer. The quadrilateral support structure 26, on the other hand, is not cantilevered, but instead offers substantial lateral stability tending to move the display panel 21 briskly and directly from its collapsed mode position shown in FIG. 3 to its forward deployed mode position shown in FIG. 2. The collapsible pop-up display assemblies of the invention thus provide a choice of different vibrational stabilities for the display panel 21.

The leaf springs of the present invention can be made from any polymer material whose properties include a memory and sufficient resiliency so that when the leaf spring is depressed about its thermoformed hinge line 37 or 46, it remains in the collapsed mode as long as desired, and then returns elastically to its released deployed mode presenting the display panel 21 a substantial distance forward from the underlying stationery panel 22 as the elastomer leaf spring returns to its normal, unstressed position by its elastic spring action. Both acetate sheet material and mylar sheet material have been employed in standard commercial thicknesses to provide highly successful and long lasting elastomer leaf springs in the assemblies of the present invention.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A self-erecting pop-up stationery display structure assembly comprising, an underlying stationery sheet;

a display panel smaller than the stationery sheet positioned overlying the stationery sheet;

and a collapsible self-erecting support incorporating two central panels spanning the space between the underlying stationery sheet and the overlying smaller display panel, the central panels having first and second end panels joined to them by a plurality of substantially parallel fold lines, the first end panel being adhesively bonded to the underlying stationery panel and the second end panel being adhesively bonded to the overlying display panel, the central panels being substantially parallel when said support is in its erect position, with at least one of the fold lines joining the end panels to the central panels being formed of resilient elastomer leaf spring sheet material having a preformed angular bend formed therein, whereby a collapsing force applied to urge the display panel toward the stationery sheet causes the central panels to fold toward the stationery sheet about the fold lines, elastically deforming the preformed angular bend in the resilient elastomer sheet as the display panel moves toward a collapsed position adjacent to the stationery panel, and whereby removal of the collapsing force releases the deformed angular bend to return elastically to its preformed bend configuration, restoring said support to its erect position and positioning the display panel in a deployed position spaced from the stationery panel.

2. The self-erecting pop-up stationery display structure assembly defined in claim 1, wherein the support is formed of stationery sheet material, with a fold line panel of resilient leaf spring elastomer sheet material incorporating said at least one of the fold lines, overlapping and adhesively bonded to one of the central panels and to one of the end panels on opposite sides of said at least one of the fold lines.

3. The self-erecting pop-up stationery display structure assembly defined in claim 1, wherein the support is a quadrilateral collapsible structure which is collapsed by folding about said fold lines, and self-erected by the elastic return of the deformed angular bend to its preformed bend configuration.

4. The self-erecting pop-up stationery display structure assembly defined in claim 1, wherein the underlying stationery sheet is formed with at least two contiguous panels, a first panel to which the support structure's first end panel is adhesively bonded, and a second panel joined to the first panel along a common fold line spaced away from the first end panel to be clear of the display panel in its collapsed mode position, whereby folding of the second panel about the common fold line toward the first panel applies the collapsing force urging the display panel toward the first panel of the stationery sheet.

5. The self-erecting pop-up stationery display structure assembly defined in claim 4, further including an envelope dimensioned to receive the stationery sheet when its contiguous panels are folded together, thereby maintaining the support structure in its collapsed mode condition.

6. A self-erecting pop-up stationery display structure assembly comprising, an underlying stationery sheet;

a display panel smaller than the stationery sheet positioned overlying the stationery sheet;

and a collapsible self-erecting support incorporating a central panel spanning the space between the underlying stationery sheet and the overlying smaller display panel, the central panel having first and second end panels joined to it by respective first and second fold lines, the first end panel being adhesively bonded to the underlying stationery panel and the second end panel being adhesively bonded to the overlying display panel, with the central panel and both end panels formed of a simple integral leaf spring sheet of resilient elastomer material, the first fold line joining the first end panel to the central panel being formed in said resilient elastomer leaf spring sheet material and being provided by a preformed angular bend formed therein and the second fold line joining the second end panel to the central panel also formed in said resilient elastomer leaf spring sheet material and being provided by a preformed angular bend formed therein, said preformed fold line angular bends forming opposite acute angles, providing the collapsible support with a Z-shaped configuration in cross-section when in its released, non-collapsed condition, whereby a collapsing force applied to urge the display panel toward the stationery sheet causes the central panel to fold toward the stationery sheet about the first and second fold lines, elastically deforming the preformed angular bends in the resilient elastomer sheet as the display panel moves toward a collapsed position adjacent to the stationery panel, and whereby removal of the collapsing force releases the deformed angular bands to return elastically to their preformed bend configurations, restoring said support to its released, non-collapsed condition and positioning the display panel in a deployed position spaced from the stationery panel.

7. The self-erecting pop-up stationery display structure assembly defined in claim 6, wherein the underlying stationery sheet is formed with at least two contiguous panels, a first panel to which the support structure's first end panel is adhesively bonded, and a second panel joined to the first panel along a common fold line spaced away from the first end panel to be clear of the display panel in its collapsed mode position, whereby folding of the second panel about the common fold line toward the first panel applies the collapsing force urging the display panel toward the first panel of the stationery sheet.

8. The self-erecting pop-up stationery display structure assembly defined in claim 11, further including an envelope dimensioned to receive the stationery sheet when its contiguous panels are folded together, thereby maintaining the support structure in its collapsed mode condition.

9. A self-erecting pop-up stationery display structure assembly comprising, an underlying stationery sheet;

a display panel smaller than the stationery sheet positioned overlying the stationery sheet;

and a collapsible self-erecting quadrilateral support formed of an integral array of four contiguous panels successively joined together by three substantially parallel scored fold lines, with a hinge panel of resilient elastomer sheet having a preformed angular bend line adhesively bonded respectively on opposite sides of its bend line to the separate opposite end panels of the four panel array, with the bend line substantially parallel to the scored fold lines, thereby completing the formation of the quadrilateral support structure, one of the panels being adhesively bonded to the underlying stationery panel and another of the panels being adhesively bonded to the overlying display panel, whereby a collapsing force applied to urge the display panel toward the stationery sheet causes the support to fold toward the stationery sheet about the fold lines, elastically deforming the preformed angular bend in the resilient elastomer sheet as the display panel moves toward a collapsed position adjacent to the stationery panel, and whereby removal of the collapsing force releases the deformed angular bend to return elastically to its preformed bend configuration, restoring said support ot its erect position and positioning the display panel in a deployed position spaced from the stationery panel.

* * * * *